US009700481B2

(12) United States Patent
Mansur, Jr. et al.

(10) Patent No.: US 9,700,481 B2
(45) Date of Patent: Jul. 11, 2017

(54) DEEP VEIN THROMBOSIS PREVENTION GARMENT HAVING AN EXPANDABLE BLADDER

(71) Applicant: Compression Therapy Concepts, Inc., Eatontown, NJ (US)

(72) Inventors: Orlando Mansur, Jr., Eatontown, NJ (US); Leonard Nass, Eatontown, NJ (US)

(73) Assignee: Compression Therapy Concepts, Inc., Eatontown, NJ (US)

( * ) Notice: Subject to any disclaimer, the term of this patent is extended or adjusted under 35 U.S.C. 154(b) by 305 days.

(21) Appl. No.: 14/217,147

(22) Filed: Mar. 17, 2014

(65) Prior Publication Data

US 2014/0276295 A1 Sep. 18, 2014

Related U.S. Application Data

(60) Provisional application No. 61/786,374, filed on Mar. 15, 2013.

(51) Int. Cl.
*A61H 9/00* (2006.01)

(52) U.S. Cl.
CPC ..... *A61H 9/0092* (2013.01); *A61H 2201/165* (2013.01); *A61H 2201/5005* (2013.01); *A61H 2205/106* (2013.01); *A61H 2209/00* (2013.01)

(58) Field of Classification Search
CPC ..... A61H 9/0078–9/0092; A61H 2201/0103; A61H 2201/165; A61H 2201/5058; A61H 2205/106; A61H 2209/00
See application file for complete search history.

(56) References Cited

U.S. PATENT DOCUMENTS

| | | | | |
|---|---|---|---|---|
| 5,626,556 | A | 5/1997 | Tobler et al. | |
| 5,634,889 | A * | 6/1997 | Gardner | A61H 9/0078 601/148 |
| 7,871,387 | B2 | 1/2011 | Tordella et al. | |
| 2004/0111048 | A1* | 6/2004 | Jensen | A61F 5/0111 602/13 |
| 2005/0070828 | A1 | 3/2005 | Hampson | |
| 2008/0216231 | A1* | 9/2008 | Lambarth | A61G 7/1026 5/81.1 HS |
| 2008/0245361 | A1 | 10/2008 | Brown | |
| 2008/0249441 | A1 | 10/2008 | Avitable | |

(Continued)

*Primary Examiner* — Rachel Young
(74) *Attorney, Agent, or Firm* — Schwegman Lundberg & Woessner, P.A.

(57) ABSTRACT

A deep vein thrombosis prevention garment includes a body having a central panel, a left side panel, and a right side panel formed with a number of attachment straps having an integral fastener, such as Velcro® brand hook and loop fasteners. The central panel is formed with a single air chamber containing a single expandable air bladder receiving air from a pump through a flexible air supply tube. The central panel, left side panel and right side panel are formed from a single material which does not require a skin-safe liner or other combination of materials. The single chamber with nested expandable bladder is attached to the central panel. A cover panel covers the chamber having an expandable bladder, and is attached along its perimeter to the central panel. The cover panel and the body are made from the same material which can be placed against a patient's skin.

13 Claims, 4 Drawing Sheets

(56) References Cited

U.S. PATENT DOCUMENTS

| | | | | |
|---|---|---|---|---|
| 2008/0249442 | A1 | 10/2008 | Brown | |
| 2008/0249443 | A1 | 10/2008 | Avitable | |
| 2008/0249444 | A1 | 10/2008 | Avitable | |
| 2008/0249447 | A1 | 10/2008 | Brown | |
| 2008/0249449 | A1 | 10/2008 | Brown | |
| 2008/0249455 | A1 | 10/2008 | Brown | |
| 2008/0306420 | A1* | 12/2008 | Vess | A61F 5/0111 602/13 |
| 2012/0079662 | A1* | 4/2012 | Dzioba | A61G 7/05776 5/713 |
| 2012/0132212 | A1* | 5/2012 | Nishtala | A61M 16/04 128/207.15 |
| 2014/0107547 | A1* | 4/2014 | Drey | A61H 9/005 601/151 |

* cited by examiner

DEEP VEIN THROMBOSIS PREVENTION GARMENT HAVING AN EXPANDABLE BLADDER

RELATED APPLICATION

This application claims the benefit of priority to U.S. Provisional Application No. 61/786,374, filed on Mar. 15, 2013, entitled "Deep Vein Thrombosis Prevention Garment Having An Expandable Bladder".

FIELD OF THE INVENTION

The present invention relates generally to medical and therapy devices. The present invention is more particularly useful as a compression garment for use in the prevention of deep vein thrombosis. The present invention is particularly useful to prevent deep vein thrombosis during periods of low or no activity by continually circulating blood through a patient's extremities.

BACKGROUND OF THE INVENTION

Deep Vein Thrombosis, or "DVT", is a blood clot ("thrombus") that forms in a vein deep in the body. A thrombus occurs when blood thickens and clumps together. Most of these thrombi occur in the lower leg or thigh; however, they can also occur in other parts of the body. Thrombi located in the thigh are more likely to break off and cause a pulmonary embolism ("PE") than clots in the lower leg or other parts of the body. The clots that form close to the skin usually cannot break off and cause a PE due to their reduced size and the reduced pressures exerted on them.

A DVT, or a portion of it, can break off and travel through the bloodstream where it can enter the lung and block blood flow. This condition is called pulmonary embolism, which is considered to be very serious due to its likelihood of causing damage to the lungs and other organs and quite possibly leading to death. This condition affects more than 2.5 million Americans each year and is associated with an estimated 50,000 to 200,000 deaths annually.

The venous system is designed to allow for the return of blood to the right side of the heart. Veins are not passive tubes through which blood passes, but is a system that uses muscular compressions, gravity, and inter-venous valves to promote and control the flow of blood through them. The valves are located along the entire length of the vein and ensure that blood only flows in one (1) direction, toward the heart. Blood flow may easily pass through the valve in the direction toward the heart, but when pressure is greater above the valve than below, the cusps will come together, thereby closing the valve and stopping the further flow of blood to the heart.

The valves consist of two (2) very thin-walled cusps that originate at opposite sides of the vein wall and come together to meet at the midline of the vein. The diameter of the vein is slightly larger just behind the valve where the cusps attach to the vein wall. Due to the larger diameter of the vein and the propensity for blood to collect and stagnate between the valve cusps and the vein wall, thrombi formation in this area is more likely.

The most common causes of DVT are venous stasis, blood vessel wall injury, and hypercoagulability. Venous stasis is the reduction of blood flow, most notably in the areas of venous valves, usually caused by extended periods of inactivity. These periods of inactivity minimize the muscular compressions applied to the veins thereby removing the forces used to propel the blood through the veins. This reduction in flow allows the blood to collect and congeal, thereby forming a clot. The conditions that contribute to venous stasis include heart disease, obesity, dehydration, pregnancy, a debilitated or bed-ridden state, stroke, and surgery. Stasis has been known to develop with surgical procedures lasting as little as 30 minutes.

Vessel wall injury can disrupt the lining of the vein, thereby removing the natural protections against clotting. The loss of natural protection will increase the chances of clot formation and the subsequent mobilization of the clot w can lead to a PE. Some of the major causes of vessel wall injury are trauma from fractures and burns, infection, punctures of the vein, injection of irritant solutions, susceptibility to DVT, and major surgeries.

Hypercoagulability exists when coagulation outpaces fibrinolysis, which is the body's natural mechanism to inhibit clot formation. When this condition exists, the chances of clot formation, especially in areas of low blood flow, are greatly increased. Some causes of hypercoagulability are trauma, surgery, malignancy, and systemic infection. A typical treatment is the administration of an anticoagulant such as of low-molecular-weight heparin.

It is recognized that clots usually develop first in the calf veins and "grow" in the direction of flow in the vein. The clots usually form behind valve pockets where blood flow is lowest. Once a clot forms, it either enlarges until it is enveloped, which causes the coagulation process to stop, or the clot may develop a "tail" which has a high chance of breaking off and becoming mobile where it can enter the pulmonary system and become lodged in the lungs.

In a patient with DVT, the goals are to minimize the risk of a PE, limit further clots, and facilitate the resolution of existing clots. If a potential clot is suspected or detected, bed rest is usually recommended to allow for the clot to stabilize and adhere to the vein wall, thereby minimizing the chance of the clot becoming mobile such that it can travel to the lungs. A more effective preventative measure is ambulation, which is to walk about or move from place to place. Ambulation requires muscle movement. The muscle movement will provide a continuous series of compressions to the veins, thereby facilitating the flow of blood. The continuous flow of blood will reduce or eliminate any areas of stasis so clots do not have a chance to form. For people who are confined to a bed or will be immobile for an extended period of time, leg elevation is recommended. This will promote blood return to the heart and will decrease any existing venous congestion.

Graduated compression stockings have also been used to apply pressure to the veins so as to reduce or minimize any areas of low flow in the vein, while not allowing the collection and coagulation of blood in these low flow areas. The stockings are designed to provide the highest level of compression to the ankle and calf area, with gradually decreasing pressure continuing up the leg. The stockings prevent DVT by augmenting the velocity of venous return from the legs, thereby reducing venous stasis. Typically, stockings are applied before surgery and are worn until the patient is fully able to move on their own. The stockings need to fit properly and be applied correctly. If too tight, they may exert a toumiquet effect, thereby promoting venous stasis, the very problem they intend to prevent. If too loose, the stockings will not provide adequate compression.

Another treatment of DVT involves the use of intermittent pneumatic compression (IPC). IPC can be of benefit to patients deemed to be at risk of deep vein thrombosis during extended periods of inactivity and is an accepted treatment method for preventing blood clots or complications of venous stasis in persons after physical trauma, orthopedic surgery, neurosurgery, or in disabled persons who are unable to walk or mobilize effectively.

An IPC uses an air pump to inflate and deflate airtight sleeves wrapped around the leg. The successive inflation and deflations simulate the series of compressions applied to the veins from muscle contractions, thereby limiting any stasis that can lead to thrombi formation. This technique is also used to stop blood clots from developing during surgeries that will last for an extended period of time.

While there are a number of airtight sleeves that have been developed for IPC, the available sleeves are created from multi-layered materials and are relatively expensive to manufacture. For instance, in currently available airtight sleeves, an air bladder is provided and encased in a multi-layered garment that requires a great deal of manufacturing effort, including the careful cutting and stitching of multiple layers of cloth suitable for prolonged placement against a patient's skin. Indeed, the airtight sleeves currently available are formed with a soft inner layer material that is suitable for contact with the skin, and an outer layer that is more durable and serves as a backing to provide the necessary compression to the patient. This two-layer construction results in an expensive and complicated manufacturing of the airtight sleeve. Also, the combination of two (2) dissimilar materials requires a perimetric piping that serves to finish the cut edges of the two (2) dissimilar materials, to connect the two (2) materials together, and to provide a finished edge.

In light of the above, it would be advantageous to provide a deep vein thrombosis prevention garment that minimizes the occurrence of deep vein thrombosis formation. It would be further advantageous to provide a deep vein thrombosis prevention garment that allows medical personnel to customize the compression of limbs being treated to optimize treatments for particular patients. It would be further advantageous to provide a deep vein thrombosis prevention garment that is made from a single panel of material, thereby minimizing manufacturing costs. It would be further advantageous to provide a deep vein thrombosis garment that initiates and directs compression of a limb from a point further down the limb (distal) in a direction toward the heart (proximal). It would be further advantageous to provide a deep vein thrombosis prevention garment that is easy to use, relatively easy to manufacture, and comparatively cost efficient.

SUMMARY OF THE INVENTION

The deep vein thrombosis prevention garment having an expandable bladder of the present invention (hereafter referred to as the "deep vein thrombosis prevention garment") includes a body having a central panel, a left side panel, and a right side panel formed with a number of attachment straps having an integral fastener, such as Velcro® brand hook and loop fasteners. The central panel is formed to have a single chamber containing an expandable bladder, which receives air from a pump through a flexible air supply tube.

The central panel, left side panel, and right side panel are formed from a single material which requires no skin-safe liner or other combination of materials. A single chamber houses an expandable bladder and is attached to the central panel. A cover panel, sized to cover the inside surface of the central panel, covers the chamber and is attached along its perimeter to the central panel. The cover panel and the body are made from the same material which can be placed against a patient's skin.

In use, the central panel is positioned against the large muscle in the limb being treated, such as the calf muscle, and the left side panel is wrapped around the limb. The attachment straps on the right side panel are wrapped around the limb from the other direction and attached to the outside surface of the left side panel to secure the device about the patient's limb.

The deep vein thrombosis prevention garment of the present invention is worn by a patient on an extremity that is subject to development of thrombosis, particularly deep vein thrombosis, and particularly during surgery or extended periods of inactivity. In use, the deep vein thrombosis prevention garment is wrapped snugly around a patient's leg, for example. Once activated, the pump provides a periodic air supply to the garment through the flexible air supply tube leading to the expandable bladder.

Pressurized air is supplied through the flexible air supply tube to the expandable bladder, which becomes pressurized to a predetermined pressure, such as 35 mmHg. As the expandable bladder inflates, it expands to fill the chamber, and provides progressive additional pressure in a proximal direction along the leg of the patient to urge blood flow further upward through the leg.

The inflation of the expandable bladder, coupled with the valves within the venous structure of the limb, creates a peristaltic force on the veins within the limb being treated. Once the expandable bladder is filled with air to expand within the chamber and pressurized to a predetermined pressure, the pressurized air supplied to the flexible air supply tube is discontinued, and the expandable bladder deflates, returning the deep vein thrombosis prevention garment of the present invention to its fully un-inflated configuration. In this fully un-inflated configuration, blood flows freely through the limb being treated.

The inflation and deflation timing cycle of the deep vein thrombosis prevention garment of the present invention is determined by the pressures being utilized, and the speed by which the expandable bladder deflates. In order to effectively urge blood flow through deep veins, the timing for the peristaltic effect of the deep vein thrombosis prevention garment of the present invention is approximately twenty (20) seconds per cycle.

BRIEF DESCRIPTION OF THE DRAWING

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF A PREFERRED EMBODIMENT

Figure 1:
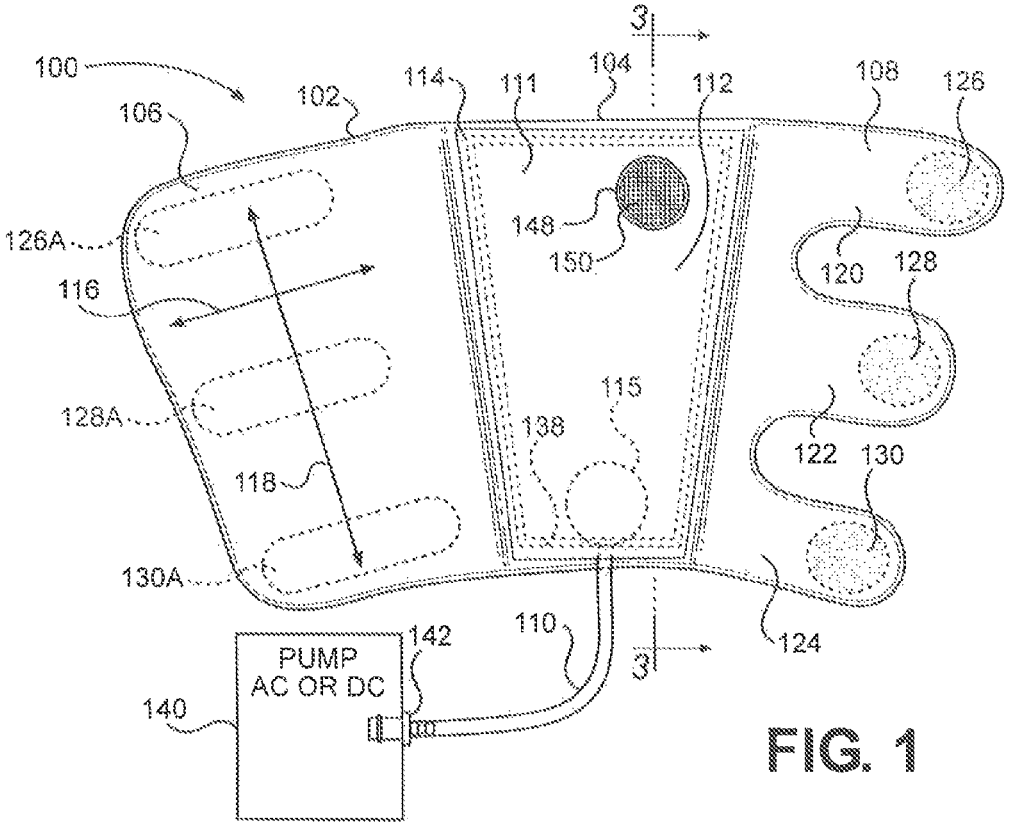
FIG. 1 is a top plan view of the deep vein thrombosis prevention garment of the present invention showing a central panel, a left side panel, and a right side panel formed with a number of attachment straps having an integral fastener, and with the central panel having a chamber (shown in dashed lines) housing an expandable bladder (shown at bottom in dashed lines), which receives air from a pump through a flexible air supply tube.

Referring initially to FIG. 1, a top plan view of the deep vein thrombosis prevention garment of the present invention is shown and generally designated 100. The deep vein thrombosis prevention garment 100 includes a single-layered body 102 having a central panel 104, a left side panel 106, and a right side panel 108. Garment panels 104, 106 and 108 are flexible and formed with a single layer. In a preferred embodiment, the single layer of body 102 of the deep vein thrombosis prevention garment 100 is made from durable cloth or other non-woven material that can comfortably contact a patient's skin. For instance, a non-woven material SONTARA made from polyester and a substantially recyclable wood pulp may be suitable for use as the inside laminate for the device.

A flexible air supply tube 110 enters central panel 104 and leads to an expandable air bladder 115 (shown in dashed lines) housed within an air filled chamber 111. A flexible air supply tube 110 having a non-descript length is shown. It is to be appreciated that the length of the flexible air supply tube 110 may vary depending on the particular field of use, and the setting. For instance, in a hospital surgery setting, it may be difficult to position an air source immediately adjacent to the patient, and an extended air supply tube 110 is required.

Expandable air bladder 115 is adopted to apply a compressive force to the leg of the patient. Air is supplied to flexible air supply tube 110 from a pump 140. In a preferred embodiment, a compressor included in pump 140 is capable of providing a predetermined maximum air pressure, is used to fill the expandable air bladder 115 to a predetermined pressure. Subsequently, the expandable air bladder 115 can provide compression therapy to the leg of the patient. Suitable materials for the expandable air bladder 115 include, but are not limited to, durable plastics such as polyvinyl chloride (PVC), poly (urethane) (PU), polyethylene (PE), polypropylene, copolymers, and any other material known in the industry.

Air supply tube 110 is equipped with a quick-disconnect connector 142 known in the industry to facilitate the changing of multiple deep vein thrombosis prevention garments 100 with pump 140. As will be described in greater detail below, pump 140 can provide air at a predetermined pressure for a predetermined period of time, providing for an inflation and deflation cycle according to the desired therapy parameters. Alternatively, pump 140 can provide air with a variable pressure to gradually inflate expandable bladder 115.

A cover panel 112 is sized to cover the air filled chamber 111 housing the expandable air bladder 115, and is attached along its perimeter 114 to central panel 104. As shown, cover panel 112 may be heat fused to central panel 104 to seal the air filled chamber 111 between the two (2) panels 112 and 104. Air filled chamber 111 may also be attached to central panel 104 to avoid movement in relation to body 102 during use.

An aperture 148 within the wall of the air filled chamber 111 is covered with membrane panel 150, and allows bidirectional airflow for pressure equilibration between the air filled chamber 111 and the ambient atmosphere to prevent vacuum effects within the air filled chamber 111 during inflation and deflation of the expandable air bladder 115. Further details of aperture 148 and membrane panel 150 are described in FIG. 7.

Body 102, in a preferred embodiment, is made from a material that exhibits different amounts of elasticity depending on the direction of the tension being applied. More specifically, body 102 may expand laterally in direction 116, and vertically in direction 118. In one embodiment, elasticity in direction 116 may be greater than elasticity in direction 118, thereby allowing the body 102 to be snugly wrapped around a patient's limb that might have a taper or enlarged midsection, such as a muscular calf. The elasticity in direction 116 allows the body 102 to stretch to accommodate the limb. Alternatively, body 102 may have little or no elasticity in orthogonal direction 118. The combination of elasticity in lateral direction 116 and little or no elasticity in vertical direction 118 provides for the deep vein thrombosis prevention garment 100 that is sufficiently structurally rigid to provide a compressive force when the expandable air bladder 115 housed within the air filled chamber 111 is inflated, yet elastic enough to accommodate limbs having differing shapes.

As shown in FIG. 1, right side panel 108 is formed with a number of attachment straps 120, 122, and 124, with each strap having an integral fastener 126, 128, and 130, respectively. In a preferred embodiment, straps 120, 122, and 124 are provided with the hook portion of hook-and-loop style fasteners 126, 128, and 130. This hook portion of the hook-and-loop fastener cooperates with the outside of body 102, and in particular left side panel 106, to allow the deep vein thrombosis prevention garment 100 of the present invention to be positioned about a patient's limb and secured in place by wrapping the panels 104, 106 and 108 around the limb and pressing the fasteners 126, 128, and 130 on straps 120, 122, and 124 firmly against outside of panel 106. The hook-and-loop fasteners are attached to the outside of panel 106 to hold the straps 120, 122, and 124 in place. This type of fastener and method of attachment of the deep vein thrombosis prevention garment 100 provide a deep vein thrombosis prevention garment 100 for patients having limbs of different sizes simply by wrapping the panels 104, 106 and 108 around the limb and securing straps 120, 122, and 124 in place. In a preferred embodiment, polyester made from recycled bottles may be used for the loop fastener material, such as yarn made from recycled polyester available from UNIFI under the trade name REPREVE.

As an alternative embodiment of the deep vein thrombosis prevention garment 100, the outer surface of right side panel 108 may be equipped with the loop portion of the hook-and-loop fasteners to provide a specific attachment point for fasteners 126, 128 and 130. Specifically, loop portions 126A, 128A and 130A (shown in dashed lines) are secured to the outer surface of left side panel 106 and positioned to receive hook portions 126, 128 and 130 of the hook-and-loop fasteners.

While the preferred embodiment of the deep vein thrombosis prevention garment 100 of the present invention is manufactured having hook-and-loop type fasteners 126, 128, and 130, it is to be appreciated that any other fastener known in the art may be used without departing from the present invention.

Figure 2:
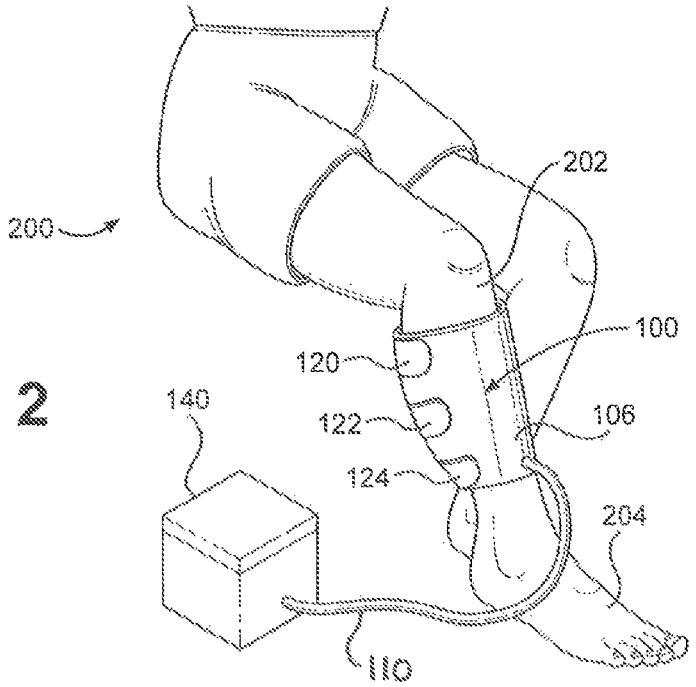
FIG. 2 is a view of the deep vein thrombosis prevention garment being used by a patient for the prevention of deep vein thrombosis, showing a pump supplying pressurized air through a flexible air supply tube.

Referring now to FIG. 2, the deep vein thrombosis prevention garment 100 of the present invention is shown being used by a patient 200 for the prevention of deep vein thrombosis. Specifically, as shown, the deep vein thrombosis prevention garment 100 is positioned around the lower leg 202, or calf, of patient 200 and in communication with pump 140 through flexible air supply tube 110. Pump 140 supplies pressurized air through flexible air supply tube 110 to pressurize the expandable bladder 115 (shown in FIG. 1) located within the deep vein thrombosis prevention garment 100.

FIG. 2 depicts patient 200 in a sitting position. However, this is merely exemplary of the typical use of the deep vein thrombosis prevention garment 100 of the present invention. Indeed, the deep vein thrombosis prevention garment of the present invention may be used with a patient in virtually any position. As will be described in greater detail below, the inflation and deflation cycle of the expandable air bladder 115 may vary depending on the particular patient and the particular environment. For instance, a patient using the deep vein thrombosis prevention garment of the present invention in a sitting position may opt for a faster inflation and deflation cycle, and may utilize higher air pressure in the expandable air bladder 115 than a patient using the deep vein thrombosis prevention garment in a supine position on an operating table.

It is also to be appreciated that while FIG. 2 depicts a patient 200 having one deep vein thrombosis prevention garment on a leg, a number of deep vein thrombosis prevention garments may be used simultaneously. For instance, in a surgery setting, it is commonplace to utilize the deep vein thrombosis prevention garment of the present invention on both legs.

As shown, deep vein thrombosis prevention garment 100 is positioned around the calf 202 of patient 200 by positioning panels 104 (shown in FIG. 1) and 106 against the patient's leg, and then wrapping straps 120, 122, and 124 of panel 108 (shown in FIG. 1) around the calf 202 and securing the straps to the outside surface of panel 106 with fasteners 126, 128, and 130 (shown in FIG. 1).

Figure 3A:
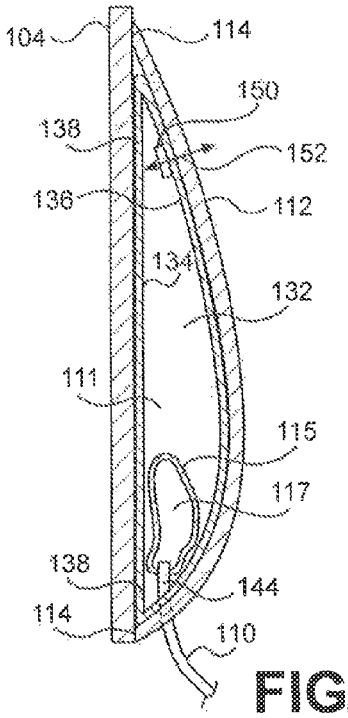
FIGS. 3A, 3B, and 3C are side cross-sectional views of the deep vein thrombosis prevention garment of the present invention as taken along line 3-3 of FIG. 1, showing the relative positions of the air filled expandable bladder within the chamber when the deep vein thrombosis prevention garment is in un-inflated (FIG. 3A), partially inflated (FIG. 3B) and fully inflated (FIG. 3C) configurations, demonstrating the flow of air from the air supply tube into the chamber to fill the expandable bladder.
Figure 3B:
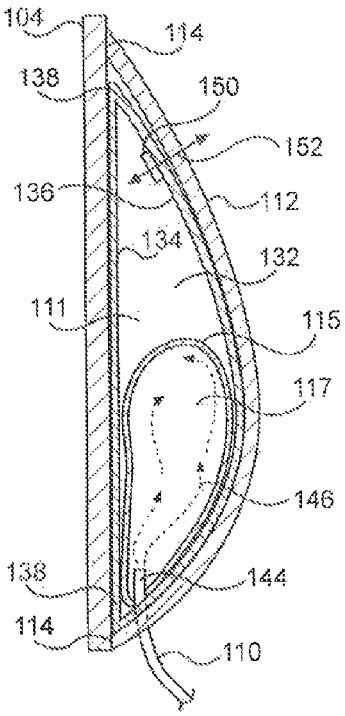
Figure 3C:
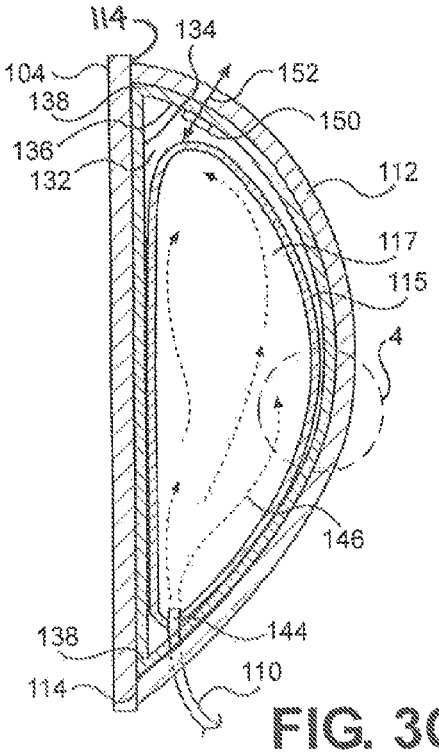

Referring now to FIGS. 3A, 3B, and 3C, side cross-sectional views of the deep vein thrombosis prevention garment 100 of the present invention as taken along line 3-3 of FIG. 1 are shown. These views depict three (3) states of inflation of the deep vein thrombosis prevention garment 100, namely, un-inflated (FIG. 3A), partially inflated (FIG. 3B), and fully inflated (FIG. 3C). As shown in FIGS. 3A, 3B, and 3C, the construction of the deep vein thrombosis prevention garment 100 includes central panel 104 with the air filled chamber 111 housing the expandable air bladder 115 covered by cover panel 112. Cover panel 112 is joined to central panel 104 at bonds 114. In a preferred embodiment, bonds 114 may be heat bonds between the central body 104 and cover panel 112, or cover panel 112 may be sewn, glued, or otherwise fastened as known in the art to central body 104.

Air chamber 111 is made using two (2) sheets 134 and 136 which together define an air cavity 132. Sheets 134 and 136 are flexible and durable, and capable of withstanding prolonged periods of inflation and deflation without damage.

In a preferred embodiment, air chamber sheets 134 and 136 are made from ECO friendly polylactic acid (PLA) films that are made from either corn or sugar. PLA is an advanced type of packaging that has typically been used for application to the containers of soft drinks and dairy products; however, it can be a film overwrap and is heat-shrinkable to size. Alternatively, the panels may be made of petroleum-based plastic films such as Polyethylene terephthalate (PET), Oriented polystyrene (OPS) and Polyvinyl chloride (PVC). Nevertheless, the PLA shrink film that has been recently-developed is an eco-friendly alternative that is typically made of corn starch. Unlike petroleum-based films, the PLA film is naturally biodegradable and provides an environmentally conscious option.

One benefit of using sheeting 134 and 136 is the ability to create seals, such as seals 138 to form the air filled chamber 111. These seals 138 may be made by sonic welding, heat sealing, or any other method known in the art. Air supply tube 110 leads to an inlet 144 which extends into air cavity 117 of expandable bladder 115 sufficient that air supplied from pump 140 (shown in FIGS. 1-2) flows in direction 146 (FIGS. 3B and 3C) into air cavity 117 to inflate the expandable bladder 115 into the air filled chamber 111 during use. Inlet 144 is sealed to sheet 136 and to expandable bladder 115 to prevent leakage. For clarity, directional arrows 146 depict the typical airflow from the flexible air supply tube 110 into the air cavity 117 of the expandable bladder 115. From these Figures, the expandability of air cavity 117 of the expandable bladder 115 is easily appreciated. As air cavity 117 is provided with pressurized air from tube 110 and pump 140, the pressure in the air cavity 117 will continue to rise expanding the expandable bladder 115 until the bladder fully contacts and is contained by the walls 134 and 136 of the air filled chamber 111, and the expandable bladder air cavity 117 pressure equalizes with the pressure of the air from pump 140.

Expandable bladder 115 must be durable and elastic with low friction characteristics, and be able to withstand prolonged periods of repeated inflation and deflation without losing its elastomeric qualities. A material which maintains high tensile strength, good surface friction characteristics and good resilience, tear and abrasion resistance would be considered optimal. Some general examples of elastic polymers for use in the deep vein thrombosis prevention garment 100 of the present invention are latex, rubber, chloroprene and silicon. It is to be appreciated that to those skilled in the art, there may be materials as well as shapes of expandable air bladder 115 known which might be most advantageous for a given patent application.

FIGS. 3A, 3B, and 3C show that membrane panel 150, which covers aperture 148 (shown in FIG. 1) formed in sheet 136, permits bi-directional air flow 152 into and out of the air filled chamber 111 upon deflation and inflation of expandable bladder 115, respectively. This prevents the air filled chamber 111 from being a sealed container and thereby prevents any potential over-pressure or vacuum effects within the air filled chamber 111 that could impede inflation and deflation of expandable bladder 115 into the air filled chamber 111 when airflow 146 passes through air tube 110. Membrane panel 150 provides no impedance to the inflation or deflation of expandable bladder 115.

Figure 4:
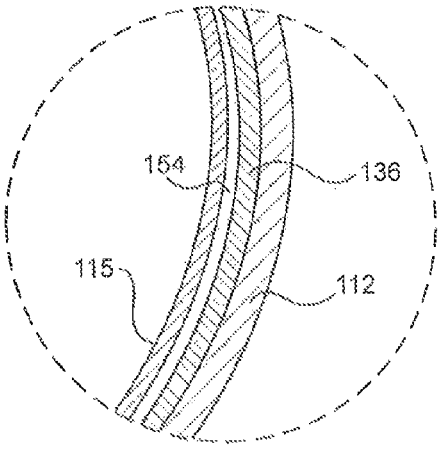
FIG. 4 is a detailed side cross-sectional view of the deep vein thrombosis prevention garment of the present as taken along line 4 of FIG. 3C, showing the layers of the expandable air bladder, a silicon layer, an air chamber sheet, and a cover panel of the deep vein thrombosis prevention garment of the present invention.

FIG. 4 is an exemplary view of a detail of the various layers of the deep vein thrombosis prevention garment 100 taken along Line 4 of FIG. 3C. From this enlarged view, the addition of a medical grade silicon layer 154 located on the inner surface of the air filled chamber 111, specifically on the interior surfaces of sheets 134 and 136, can be seen. The silicon layer 154 is utilized to minimize friction between these two (2) sheets and the expandable bladder 115 as the bladder inflates and deflates in air cavity 132 of the air filled chamber 111.

Figure 5C:
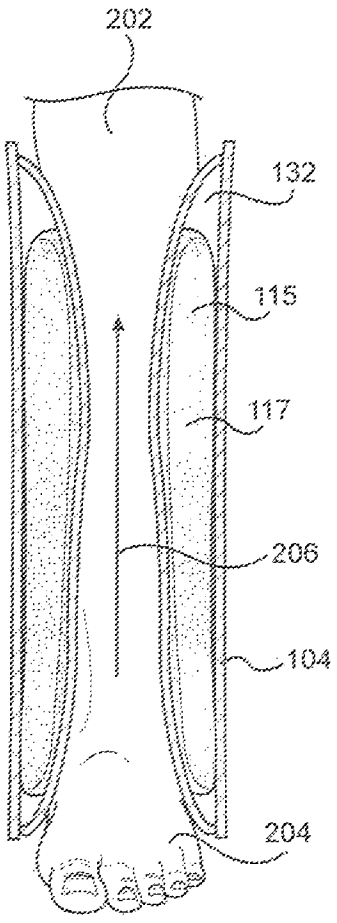
FIGS. 5A, 5B, and 5C depict the deep vein thrombosis prevention garment of the present invention as used on the leg of a patient starting with an un-inflated configuration (FIG. 5A), and advancing through the partial (FIG. 5B) and full (FIG. 5C) inflation of the expandable bladder within the chamber.
Figure 5B:
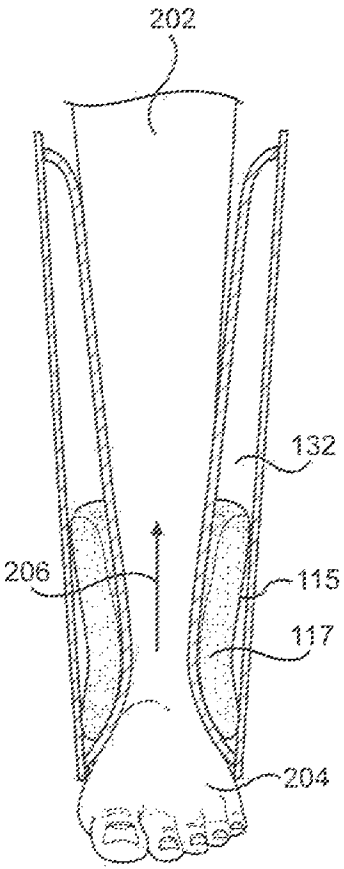
Figure 5A:
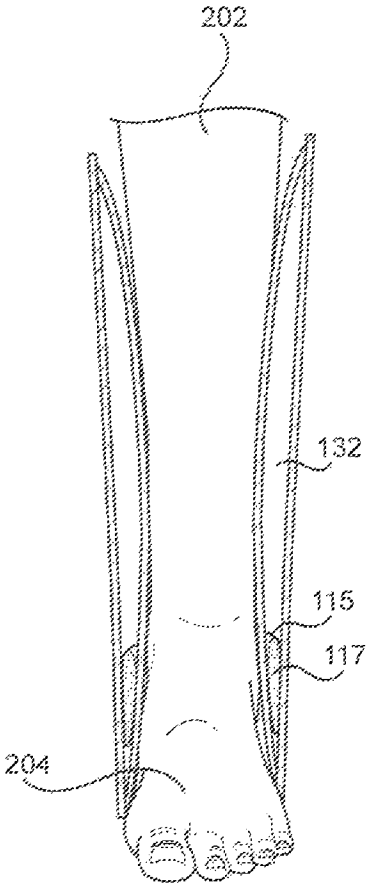

Referring now to FIGS. 5A, 5B and 5C, the deep vein thrombosis prevention garment 100 of the present invention is shown as used on the leg 202 of a patient starting with an un-inflated configuration in FIG. 5A, and continuing through partial inflation in FIG. 5B to a fully inflated configuration in FIG. 5C.

Starting with FIG. 5A, an exemplary view of the deep vein thrombosis prevention garment 100 of the present invention is shown in partial cross-section as used on the leg 202 of the patient 200 (shown in FIG. 2), showing the deep vein thrombosis prevention garment 100 in a deflated configuration. In the deflated configuration, little or no pressure is exerted on the leg 202 of the patient 200 and blood flows through the leg without restriction. In FIG. 5B, air is introduced into tube 110 (shown in FIGS. 1, 2, and 3A-3C) and begins to fill air cavity 117 of the expandable air bladder 115 (as depicted in FIG. 3B with air flows 146), and expandable air bladder 115 expands to fill air cavity 132 exerting pressure distally to leg 202.

As shown in FIGS. 5B and 5C, as air is continually introduced into air cavity 117 of expandable air bladder 115, an increase in pressure is applied initially to the distal end of leg 202 of the patient (FIG. 5B) progressing to the proximal end (FIG. 5C) to urge blood flow upward from the foot 204 through the leg 202 in direction 206. Specifically, inflation of expandable air bladder 115 creates a pressure on the limb 202 of patient.

When a single inflation cycle is completed, the air pump 140 (shown in FIGS. 1-2) releases the air pressure to air supply tube 110 (shown in FIGS. 1, 3A, 3B and 3C), and air dissipates through the air supply tube 110 in reverse of direction 146 (shown in FIGS. 3B and 3C) to return the deep vein thrombosis prevention garment 100 of the present invention to its deflated state as shown in FIG. 5A. Following a delay, this cycle is repeated according to a particular patient profile, and may be repeated for extended periods of time in order to minimize the likelihood that thrombosis will develop in the patient.

This cyclic pressure of an inflation cycle, in combination with the inter-venous valves present in the circulatory system, provides a peristaltic force to blood within the limb. The peristaltic force results in the near continual movement of blood within the limb being treated, thereby avoiding the formation of deep vein thrombosis.

Figure 6:
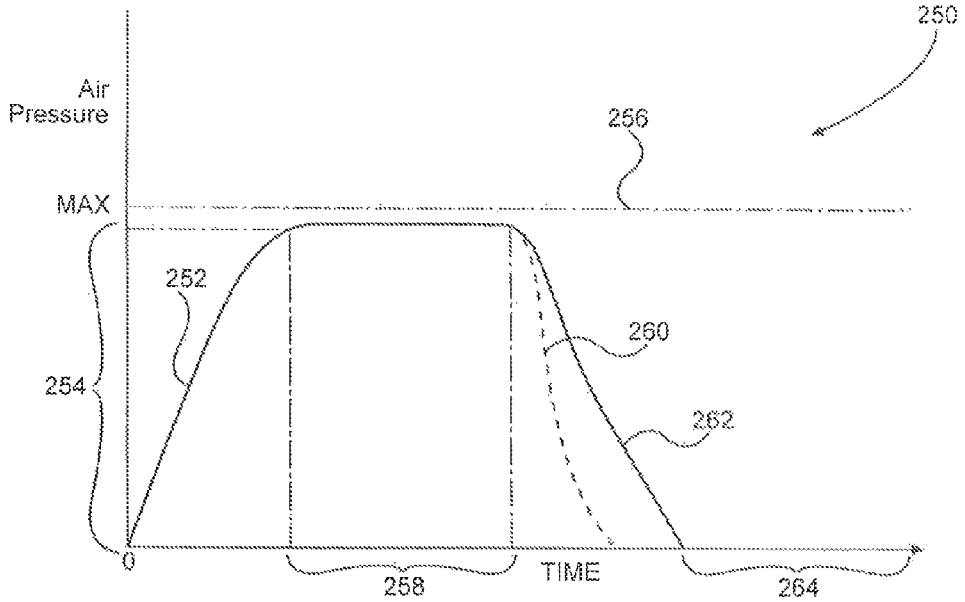
FIG. 6 is a graphical representation of the air pressure supplied from the pump to the expandable bladder of the deep vein thrombosis prevention garment of the present invention, showing a maximum air pressure to be delivered and the pressure within the air filled bladder during an inflation cycle before pressure supplied from the pump is released and the expandable bladder deflates.

Referring now to FIG. 6, a graphical representation of the air pressure supplied from the pump 140 (shown in FIGS. 1-2) to the deep vein thrombosis prevention garment 100 of the present invention is shown and generally designated 250. Graph 250 includes a vertical Air Pressure axis and a horizontal Time axis. This graph 250 depicts a typical inflation and deflation cycle that occurs in the deep vein thrombosis prevention garment 100 of the present invention.

Graph 250 includes a primary supply air pressure curve 252 which corresponds to the air provided by pump 140 to flexible air supply tube 110 (shown in FIGS. 1, 3A, 3B and 3C). This air supply begins at the start of the inflation cycle and rises to a maximum supplied air pressure 254. This maximum supplied air pressure 254 is approximately equal to an overall maximum pressure 256 (shown by dashed line) that corresponds to the maximum desired pressure within expandable air bladder 115 (shown in FIGS. 1, 3A, 3B and 3C), the maximum pressure medically safe, or any other maximum value utilized in the art to ensure safe operation of the deep vein thrombosis prevention garment 100.

In the deep vein thrombosis prevention garment 100 of the present invention, the preferred maximum pressure for expandable bladder 115 is 35 mmHg. It is to be appreciated, however, that different air pressures may be utilized for differing applications, treatment positions, duration of treatment, and other factors known and considered in the art.

The inflation cycle is completed, once the expandable bladder 115 has had sufficient time to inflate. Following the inflation cycle, a delay 258 may be utilized to maintain a constant pressure on the limb 202 (shown in FIGS. 2, 5A, 5B and 5C) to provide time for the blood to flow through the limb. Following any delay, the deflation cycle begins and the pressure 260 in air supply tube 110 decreases to zero.

As the decrease in air supply tube pressure 260 occurs, the pressure 262 in the air cavity 117 of the expandable bladder 115 likewise returns to zero in substantially the same time. Once this inflation and deflation cycle is completed, a delay 264 may be inserted prior to beginning the next inflation and deflation cycle.

Using the deep vein thrombosis prevention garment 100 of the present invention, the time for a complete inflation cycle, deflation cycle and delay is approximately twenty (20) seconds. As a result, the deep vein thrombosis prevention garment 100 can be cycled three (3) times every minute in order to provide a continuous proximal to distal force to create the desired peristaltic effect. It is to be appreciated that the specific period for a complete cycle may be changed depending on the size of the limb being treated, the pressure desired, and the peristaltic forces necessary to minimize the likelihood of the development of a thrombosis.

Figure 7:
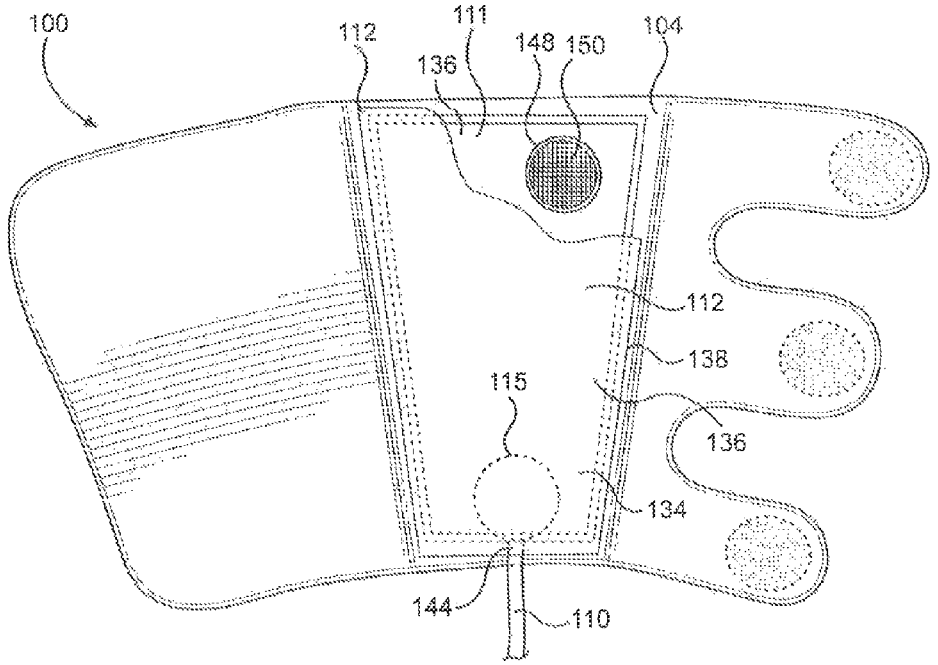
FIG. 7 is a top plan view, similar to FIG. 1, of the deep vein thrombosis prevention garment of the present invention, showing two (2) cutaway portions: a first cutaway of the central panel revealing the aperture and membrane panel in the wall of the chamber that houses the expandable bladder, and a second cutaway revealing the expandable bladder as well as the front and back layers that form the chamber housing the expandable bladder.

FIG. 7 is a top plan view of the deep vein thrombosis prevention garment 100 of the present invention with two (2) portions cut away for clarity. The deep vein thrombosis prevention garment 100 includes central panel 104 having the air filled chamber 111 shown with covering 112 (with portions cut away for clarity). Air filled chamber 111 includes a membrane panel 150 for releasing any over- or under-pressure within the air filled chamber 111 that would be created during inflation or deflation of expandable bladder 115 inside the air filled chamber 111, respectively. Specifically, an aperture 148 may be formed in sheet 136 of the air filled chamber 111 and covered with membrane panel 150. Membrane panel 150 is a non-woven material that provides resistance to the flow of air through the membrane. When the pressure within the air filled chamber 111 exceeds a maximum value, air passes through membrane 150 to release the excess pressure, positive or negative, thereby preventing excessive air pressure within the air filled chamber 111.

Membrane panel 150 may be affixed to sheet 136 of the air filled chamber 111 using heat sealing, sonic welding, adhesive, or other methods known in the art. Membrane panel 150 is sized larger than aperture 148, and may be selected from synthetic non-woven materials having varying air transmissivity ratings thereby allowing the pressure within the air filled chamber 111 to be regulated to a maximum value.

The second cutaway of FIG. 7 reveals the housing of expandable bladder 115 within the air filled chamber 111, which is formed from sheet 134 and sheet 136 sealed along seal 138. It shows the air supply tube 110 leading to the air inlet 144 extending into air cavity 117 of expandable bladder 115.

While there have been shown what are presently considered to be preferred embodiments of the present invention, it will be apparent to those skilled in the art that various changes and modifications can be made herein without departing from the scope and spirit of the invention.

We claim:

1. A deep vein thrombosis prevention garment, comprising:

a first panel having an expandable bladder positioned inside an air chamber, the expandable bladder being configured to receive-air from a flexible air supply tube in fluid communication with the expandable bladder;

a cover having a perimeter positioned over said air chamber to capture said air chamber between said first panel and said cover;

a fastener configured to fasten a first side of the deep vein thrombosis prevention garment to a second side of the garment, wherein an aperture is formed in said air chamber; and a continuous membrane panel made of a non-woven material covering said aperture and configured for bi-directional air flow through the membrane panel to maintain the air chamber at ambient pressure, wherein a friction reducing layer is located on interior surfaces of the air chamber and/or the expandable bladder is constructed from low friction material, and wherein, in a deflated condition, the expandable bladder occupies less than half of the air chamber and is positioned in only a distal portion of the air chamber and, in an inflated condition, the expandable bladder occupies more than half of the air chamber.

2. The deep vein thrombosis prevention garment of claim 1, further comprising a pump in communication with said flexible air supply tube to provide air having a predetermined pressure sufficient to inflate said expandable bladder.

3. The deep vein thrombosis prevention garment of claim 2, wherein said predetermined pressure is 35 mmHg.

4. The deep vein thrombosis prevention garment of claim 2, further comprising said pump configured to provide air at the predetermined pressure for a fixed period of time.

5. The deep vein thrombosis prevention garment of claim 1, further comprising a means for releasing air pressure from said bladder.

6. The deep vein thrombosis prevention garment of claim 1, further comprising a means for pressurizing said expandable bladder to 35 mmHg.

7. The deep vein thrombosis prevention garment of claim 1, further comprising both the friction reducing layer located on the interior surfaces of the air chamber and the expandable bladder being constructed from low friction material.

8. The deep vein thrombosis prevention garment of claim 1, wherein the friction reducing layer is silicone.

9. A deep vein thrombosis prevention garment, comprising:

a first panel having an expandable bladder positioned inside an air chamber, the expandable bladder being configured to receive air from a flexible air supply tube in fluid communication with the expandable bladder;

a cover positioned over said air chamber to capture said air chamber between said first panel and said cover; and a fastener configured to fasten a first side of the deep vein thrombosis prevention garment to a second side of the garment, wherein a friction reducing layer is located on interior surfaces of the air chamber and/or the expandable bladder is constructed from low friction material, and wherein, in a deflated condition, the expandable bladder occupies less than half of the air chamber and is positioned in only a distal portion of the air chamber and, in an inflated condition, the expandable bladder occupies more than half of the air chamber.

10. The deep vein thrombosis prevention garment of claim 9, further comprising an aperture formed in said air chamber and a continuous membrane panel made of a non-woven material covering said aperture and configured for bi-directional air flow through the membrane panel to maintain the air chamber at ambient pressure.

11. The deep vein thrombosis prevention garment of claim 9, further comprising both the friction reducing layer located on the interior surfaces of the air chamber and the expandable bladder being constructed from low friction material.

12. The deep vein thrombosis prevention garment of claim 9, wherein the expandable bladder is inflatable in a proximal direction from its deflated condition inside the air chamber, such that the expandable bladder is configured to exert a peristaltic force on a patient's limb during inflation.

13. The deep vein thrombosis prevention garment of claim 9, further comprising a pump in communication with said flexible air supply tube to provide air having a predetermined pressure sufficient to inflate said expandable bladder.

* * * * *